US012663011B2

(12) United States Patent
Ford et al.

(10) Patent No.: US 12,663,011 B2
(45) Date of Patent: Jun. 23, 2026

(54) TEMPERATURE RANGE EXTENSION FOR ELECTRIC COMPRESSOR

(71) Applicant: DANFOSS A/S, Nordborg (DK)

(72) Inventors: Frank Ford, Tallahassee, FL (US); Jason Eick, Tallahassee, FL (US); Brandon Keith Pritchard, Tallahassee, FL (US); Lin Xiang Sun, Tallahassee, FL (US)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 18/751,472

(22) Filed: Jun. 24, 2024

(65) Prior Publication Data

US 2025/0020134 A1 Jan. 16, 2025

Related U.S. Application Data

(60) Provisional application No. 63/512,714, filed on Jul. 10, 2023.

(51) Int. Cl.

| | |
|---|---|
| ***F04D 25/06*** | (2006.01) |
| ***F04D 27/00*** | (2006.01) |
| ***F04D 29/058*** | (2006.01) |
| ***F04D 29/58*** | (2006.01) |

(52) U.S. Cl.

CPC ..... *F04D 25/06* (2013.01); *F04D 27/00* (2013.01); *F04D 29/058* (2013.01); *F04D 29/584* (2013.01)

(58) Field of Classification Search

CPC ..... F04D 25/06; F04D 27/00; F04D 29/058; F04D 29/584; F04D 29/048; F04D 27/001; H02K 11/20; H02K 11/25; H02K 11/30; H02K 7/09; H02K 7/106; H02K 2211/00

USPC ..... 417/44.1

See application file for complete search history.

(56) References Cited

U.S. PATENT DOCUMENTS

| | | | | |
|---|---|---|---|---|
| 5,980,218 | A * | 11/1999 | Takahashi | F04D 29/5806 417/369 |
| 10,392,018 | B1 * | 8/2019 | Rhodes | B60L 58/25 |
| 2010/0011788 | A1 | 1/2010 | Lifson et al. | |
| 2018/0001738 | A1 * | 1/2018 | Vehr | B60H 1/3216 |

FOREIGN PATENT DOCUMENTS

| | | | |
|---|---|---|---|
| DE | 2639019 A1 | 3/1978 | |
| WO | WO-9835849 A1 * | 8/1998 | B60H 1/3204 |

OTHER PUBLICATIONS

European Search Report for EP Application No. 24185137.7 dated Nov. 12, 2024.

* cited by examiner

*Primary Examiner* — Mark A Laurenzi
*Assistant Examiner* — Kelsey L Stanek
(74) *Attorney, Agent, or Firm* — Carlson, Gaskey & Olds, P.C.

(57) ABSTRACT

An electric compressor includes an electric motor including a rotor and stator and a shaft rotating with the rotor to drive a compressor impeller. Bearings support the shaft. A housing encloses the impeller shaft, the bearings and the electric motor, and a sensor for sensing a condition within the housing. A control for the electric motor receives information from the sensor indicative of the potential of migrated refrigerant when the electric motor is not running. The control is operable to actuate a countermeasure to deliver heat into the housing to boil off the migrated refrigerant. A method is also disclosed.

20 Claims, 2 Drawing Sheets

TEMPERATURE RANGE EXTENSION FOR ELECTRIC COMPRESSOR

RELATED APPLICATION(S)

This application claims the benefit of U.S. Provisional Application No. 63/512,714 filed Jul. 10, 2023, the entirety of which is herein incorporated by reference.

BACKGROUND

This application relates to extending the operating range of ambient temperature for an electric refrigerant compressor to be lower.

Refrigerant compressors are known, and utilized for any number of applications. One common use is in air treatment systems such as an air conditioner or heat pump. Air chillers are a common use.

Refrigerant circulates through a circuit. The refrigerant is compressed in an electric compressor and delivered into a condenser where heat is taken out of the refrigerant. The refrigerant then passes through an expansion device where its pressure is lowered and it becomes cool. The refrigerant next passes into an evaporator where it cools another fluid such as air. The refrigerant then returns to the electric compressor.

Electric compressors in such systems have challenges, particularly at low temperature. As an example, when the electric compressor is shutdown the refrigerant can migrate in such a way as to raise challenges upon startup. If the refrigerant has accumulated in the area of a shaft driven with the electric compressor, as an example, it can cause challenges. As one example, it could increase the startup torque significantly to trigger the motor current protection causing the compressor to fail at startup. In fact, in extreme cases it can add extensive load on the shaft and result in the shaft hitting bearings.

These challenges have limited the lower end of a temperature range.

SUMMARY

In a featured embodiment, an electric compressor includes an electric motor including a rotor and stator and a shaft rotating with the rotor to drive a compressor impeller. Bearings support the shaft. A housing encloses the impeller shaft, the bearings and the electric motor, and a sensor for sensing a condition within the housing. A control for the electric motor receives information from the sensor indicative of the potential of migrated refrigerant when the electric motor is not running. The control is operable to actuate a countermeasure to deliver heat into the housing to boil off the migrated refrigerant.

In another embodiment according to the previous embodiment, the bearings are magnetic bearings and the countermeasure is to actuate the magnetic bearings when the electric motor is not running.

In another embodiment according to any of the previous embodiments, the countermeasure is the electric motor being controlled to generate heat while the system is idle.

In another embodiment according to any of the previous embodiments, the countermeasure runs the electric motor at a low speed so as to act as a heat source, when the system is idle.

In another embodiment according to any of the previous embodiments, a check valve is positioned downstream of the compressor impeller, and opens when the compressor impeller pressurizes a refrigerant to a sufficient pressure. The low speed is defined as running the electric motor such that the compressor impeller will not pressurize the refrigerant enough to open the check valve.

In another embodiment according to any of the previous embodiments, the countermeasure is the rotor is provided with an electric brake so as to act as a heat source, when the system is idle.

In another embodiment according to any of the previous embodiments, the electric motor is an AC motor, and the electric brake is controlled by supplying a DC voltage to the electric motor.

In another embodiment according to any of the previous embodiments, the countermeasure is actuated at least thirty seconds before an intended startup of the electric compressor.

In another embodiment according to any of the previous embodiments, the countermeasure is cycled on and off.

In another embodiment according to any of the previous embodiments, the countermeasure is disabled if a threshold temperature is reached within the electrical compressor.

In another featured embodiment, a method of operating a compressor includes the steps of determining that an electric motor for a compressor is not driving an impeller for the compressor. Conditions are evaluated with the housing to determine if they are indicative of the likely presence of migrated refrigerant when the electric motor is not driving the impeller. Countermeasures are taken to boil off the migrated refrigerant within the housing, and while the electric motor is not driving the impeller.

In another embodiment according to any of the previous embodiments, the electric motor includes a rotor driving a shaft to in turn drive the impeller, and the shaft is supported on magnetic bearings. The countermeasure includes actuating the magnetic bearings to deliver heat into the housing when the electric motor is not driving the impeller.

In another embodiment according to any of the previous embodiments, the electric motor includes a rotor provided with an electric brake, and the countermeasure includes actuating the electric brake while the electric motor is not driving the impeller.

In another embodiment according to any of the previous embodiments, the electric motor is an AC motor, and the countermeasure is the electric brake is controlled by supplying a DC voltage to the electric motor.

In another embodiment according to any of the previous embodiments, the countermeasure is actuated at least thirty seconds before an intended startup of the electric compressor.

In another embodiment according to any of the previous embodiments, the countermeasure runs the electric motor at low speed.

In another embodiment according to any of the previous embodiments, a check valve is positioned downstream of the compressor impeller, and opens when the compressor impeller pressurizes a refrigerant to a sufficient pressure. The low speed is defined as running the electric motor such that the compressor impeller will not pressurize the refrigerant enough to open the check valve.

In another embodiment according to any of the previous embodiments, the countermeasure is actuated at least thirty seconds before an intended startup of the electric compressor.

In another embodiment according to any of the previous embodiments, the countermeasure is cycled on and off.

In another embodiment according to any of the previous embodiments, the countermeasure is disabled if a threshold temperature is reached within the electrical compressor.

These and other features will be best understood from the following drawings and specification, the following is a brief description.

DETAILED DESCRIPTION

Figure 1A:
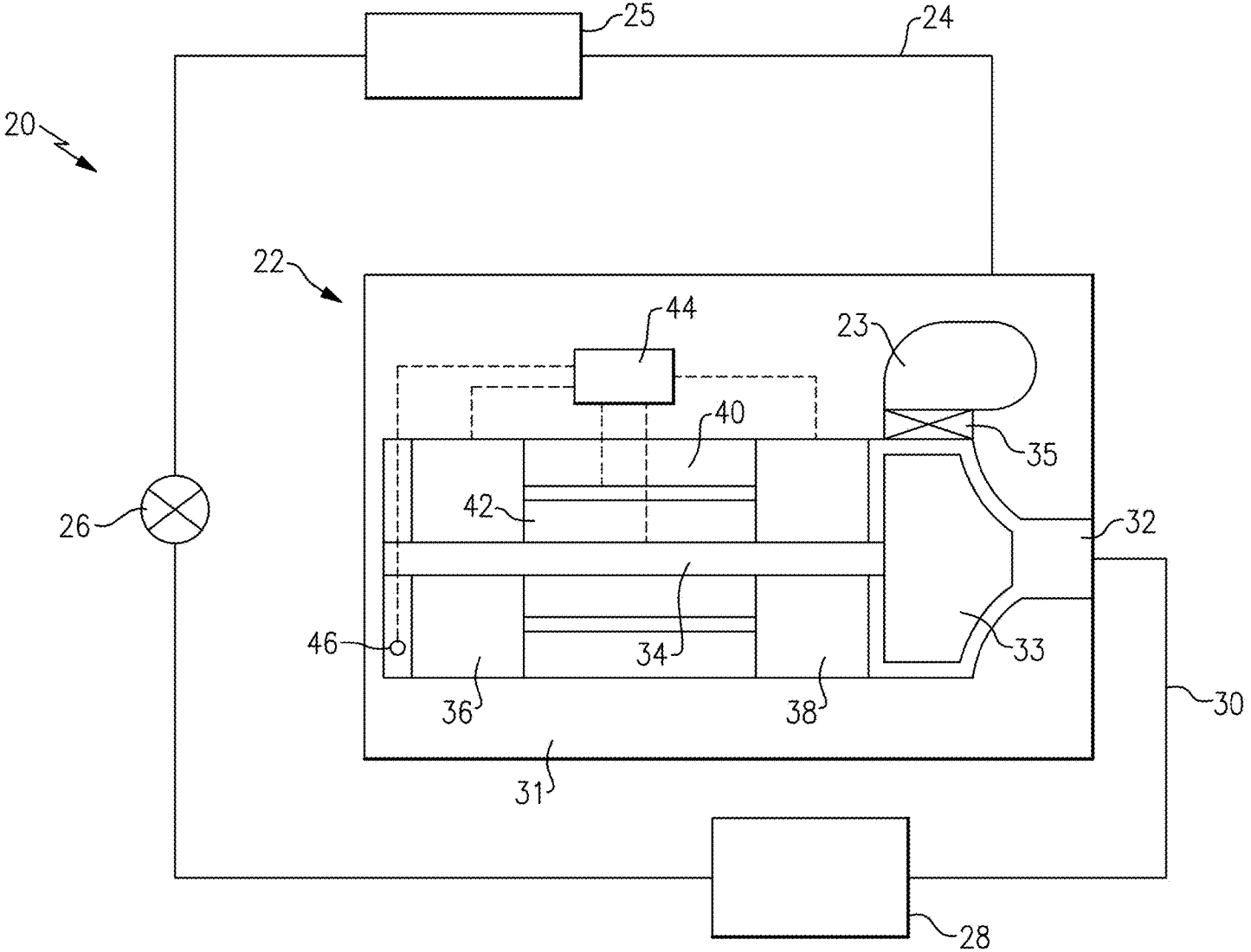
FIG. 1A schematically shows a refrigerant circuit.

FIG. 1A illustrates a refrigerant system 20. The refrigerant system 20 includes a main refrigerant loop, or circuit, 24 in communication with a compressor 22, a condenser 25, an evaporator 28, and an expansion device 26. This refrigerant system 20 may be used in a chiller, for example. In that example, a cooling tower may be in fluid communication with the condenser 25. While a particular example of the refrigerant system 20 is shown, this application extends to other refrigerant system configurations, including configurations that do not include a chiller. For instance, the main refrigerant loop 24 can include an economizer downstream of the condenser 16 and upstream of the expansion device 26.

A housing 31 surrounds the electric compressor 22. An inlet 32 delivers refrigerant to impeller 33. The impeller 33 delivers compressed refrigerant to an outlet 23. From outlet 23 the refrigerant passes through circuit 24 to condenser 25. As known, the refrigerant is cooled in the condenser.

The refrigerant next passes through an expansion device 26 which expands the refrigerant to lower pressure and temperature. The refrigerant next passes through evaporator 28 where the refrigerant is allowed to cool a second fluid such as air. The refrigerant next passes into a passage 30 back to inlet 32.

In the disclosed compressor 22 there are magnetic bearings 36 and 38 supporting the shaft 34. A motor rotor 42 rotates with the shaft 34. A motor stator 40 drives the rotor 42, and hence shaft 34 and rotor 33, to rotate when energized. The motor is an AC motor. A control 44 is shown communicating with the rotor 42, stator 40 and the magnetic bearings 36 and 38. Control 44 is also shown communicating with a sensor 46.

A discharge valve 35 is shown downstream of the impeller 33. As known, the discharge valve 35 may be a check valve that opens when the pressure of the refrigerant downstream of the impeller 33 exceeds a predetermined minimum. The location and operation of the valve 35 may be as known. It is shown here schematically.

Figure 1B:
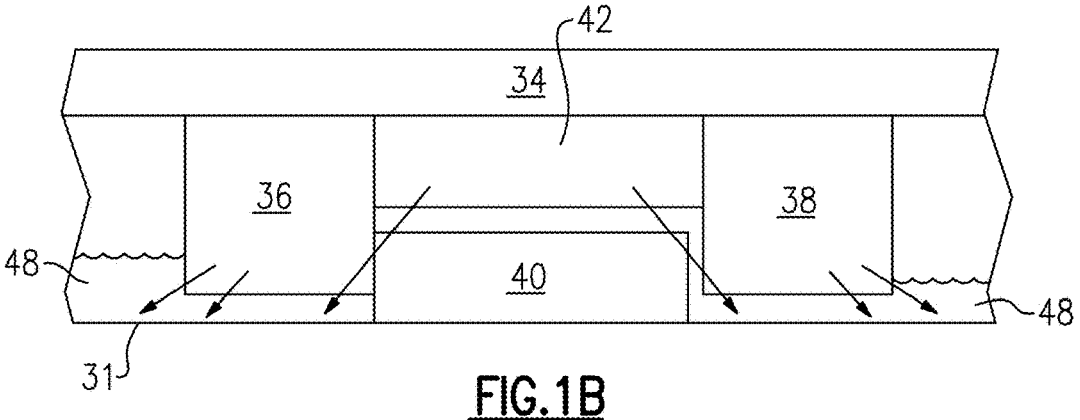
FIG. 1B shows a challenge with such a circuit.

FIG. 1B shows a problem as discussed above. As shown, the rotor 42, shaft 34 and bearings 36 and 38 along with stator 40 are within housing 31. Pooled refrigerant 48 is shown. The amount of pooled refrigerant may be exaggerated. Such conditions can happen when the compressor is in standby mode or not running at low ambient temperature.

Figure 2:
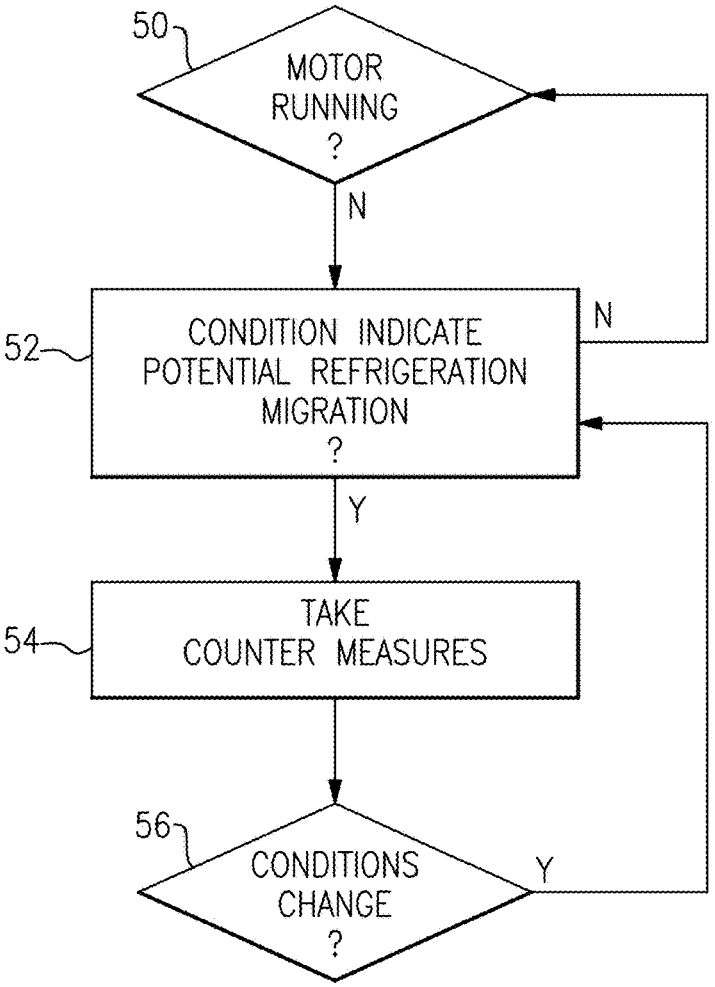
FIG. 2 is a flow chart for a method incorporated under this disclosure.

FIG. 2 is a flow chart for a method and control according to this disclosure. At step 50 the question is asked is the motor running. If the answer is no, then step 52 asks if conditions indicate potential refrigeration migration. Low ambient temperatures would be one such indicator. Such conditions would be supplied to the control 44 by the sensor 46. Sensor 46 may be a temperature sensor, or could be a sensor capable of sensing the presence of liquid refrigerant 48 as shown in FIG. 1B.

As an example, the compressor 20 in the prior art may have an operating range above −1° C. and below 51° C. Outside of that range, the compressor would typically not be operational due to too much pooled refrigerant.

However, customers for systems such as the refrigerant system shown in FIG. 1A would like to utilize such systems in any number of environments. Thus, the −1° C. range for the current compressor is a limitation. While various supplemental systems can be utilized (such as use of a heater) to allow lower temperature operation, this complicates the system.

Returning to the flow chart at step 54, if step 52 determines conditions indicate potential refrigeration migration, then countermeasures are taken.

In one example the control 44 may energize the magnetic bearings 36 and 38. This will deliver heat as shown schematically by arrows in FIG. 1B into the refrigerant 48. This will tend to boil off the refrigerant such that when the motor is again energized the problem mentioned above will be reduced, or even eliminated. This measure will be taken while the motor is not running.

A second potential countermeasure, which can be done separately, or in combination, with the first countermeasure is to turn the motor as a heat source instead of driving the compression operation. One measure could be running the motor at a low speed that has the net effect of generating heat, but not compression.

For purposes of this disclosure, and interpreting the claims, the term "low speed" means operating the compressor at a speed such that the pressure of the refrigerant compressed by the impeller 33 is not sufficient to open the valve 35.

Another measure could be to effect an electric brake on the rotor 42. A DC current may be passed to the rotor 42 to prevent rotation under certain circumstances. By actuating this brake, even though the motor is not running, additional heat is delivered into the refrigerant 48 as shown by the arrows in FIG. 1B.

To operate the electric motor as a DC brake, one applies a fixed magnitude stationary voltage on the stator terminals. This induces a current through the windings which generates a static magnetic field on the rotor magnets, aligning the two. The higher the voltage applied, the higher the current and the stronger the magnetic field. The magnetic field which is created has losses, in the form of heat, in the stator as well as in the rotor. These losses will heat the refrigerant and eventually boil it off. The larger the field that is generated, the higher the losses and the faster the refrigerant will boil off. The same principle can be used with the magnetic bearings, whereby a fixed current may be supplied through the magnetic bearing, pushing on the shaft in a static direction (not levitating in a normal operation) and generating heat.

If this is done, logic may be included to disable the intentional heating if a certain thermal threshold or time limit was reached on either the motor or the magnetic bearing. This will prevent internal heating of the bearing or motor windings that could result in damage to the machine.

In embodiments, the countermeasures could be cycled on and off, much like a home heater or air conditioning system, to regulate the liquid level. If there is an unduly large accumulation of liquid refrigerant, say when the machine has been unpowered for some time, it may take multiple cycles of the countermeasures to convert all of the liquid refrigerant to gas.

In embodiments, the countermeasures will typically be utilized for a minimum period of time. In one embodiment the minimum period of time is 30 seconds before the electric motor is energized. In narrower embodiments, the minimum period of time would be at least one minute. Also in embodiments the maximum period of time before the motor is started and the countermeasures are ongoing would be less than 10 minutes. Of course in the cyclic operation as mentioned above, it could be a relatively long period of time until the motor is started after the countermeasures have begun. However, the countermeasures will not be occurring for greater than 10 minutes straight under such a scenario.

By utilizing the countermeasures as disclosed here the safe operating range for the compressor 22 may be significantly lowered, such as on the order of down to −32° C.

Returning to FIG. 2, after the countermeasures have occurred at step 56 the question is asked if the conditions have changed. One way this may be done is if the liquid level or temperature from sensor 46 are now acceptable.

If conditions have changed the flow chart returns to step 52. At some point the motor will be restarted to run the system and this disclosure will ensure that the compressor will be able to startup at that time.

Although an embodiment has been disclosed, a worker of skill in this art would recognize that modifications would come within the scope of this disclosure. For that reason, the following claims should be studied to determine the true scope and content of this disclosure.

What is claimed is:

1. An electric compressor comprising:

an electric motor including a rotor and stator and a shaft rotating with the rotor to drive a compressor impeller;

bearings supporting the shaft;

a housing enclosing the shaft, the bearings and the electric motor, and a sensor for sensing a condition within the housing;

a control for the electric motor receiving information from the sensor indicative of the potential of migrated refrigerant when the electric motor is not running, and the control being operable to actuate a countermeasure to deliver heat into the housing to boil off the migrated refrigerant; and wherein at least one of the following is true:

wherein the bearings are magnetic bearings and the countermeasure is to actuate the magnetic bearings when the electric motor is not running; and/or wherein the countermeasure is the electric motor being controlled to generate heat while the system is idle, the countermeasure is running the electric motor at a low speed so as to act as a heat source when the system is idle, and a check valve is positioned downstream of the compressor impeller, and opens when the compressor impeller pressurizes a refrigerant to a sufficient pressure, and the low speed is defined as running the electric motor such that the compressor impeller will not pressurize the refrigerant enough to open the check valve; and/or wherein the countermeasure is the rotor being provided with an electric brake so as to act as a heat source when the system is idle, wherein the electric motor is an AC motor, and the electric brake is controlled by supplying a DC voltage to the electric motor.

2. The electric compressor as set forth in claim 1, wherein the bearings are magnetic bearings and the countermeasure is to actuate the magnetic bearings when the electric motor is not running.

3. The electric compressor as set forth in claim 1, wherein the countermeasure is the electric motor being controlled to generate heat while the system is idle.

4. The electrical compressor as set forth in claim 3, the countermeasure is running the electric motor at the low speed so as to act as the heat source, when the system is idle.

5. The electric compressor as set forth in claim 4, wherein the check valve is positioned downstream of the compressor impeller, and opens when the compressor impeller pressurizes the refrigerant to the sufficient pressure, and the low speed is defined as running the electric motor such that the compressor impeller will not pressurize the refrigerant enough to open the check valve.

6. The electrical compressor as set forth in claim 3, wherein the countermeasure is the rotor is provided with the electric brake so as to act as the heat source, when the system is idle.

7. The electric compressor as set forth in claim 6, wherein the electric motor is the AC motor, and the electric brake is controlled by supplying the DC voltage to the electric motor.

8. The electric compressor as set forth in claim 1, wherein the countermeasure is actuated at least thirty seconds before an intended startup of the electric compressor.

9. The electric compressor as set forth in claim 1, wherein the countermeasure is cycled on and off.

10. The electric compressor as set forth in claim 1, wherein the countermeasure is disabled if a threshold temperature is reached within the electrical compressor.

11. A method of operating a compressor comprising the steps of:

determining that an electric motor for a compressor is not driving an impeller for the compressor;

evaluating conditions within the housing to determine if they are indicative of the likely presence of migrated refrigerant when the electric motor is not driving the impeller; and taking a countermeasure to boil off the migrated refrigerant within the housing, and while the electric motor is not driving the impeller;

wherein at least one of the following is true:

the countermeasure is actuating magnetic bearings when the electric motor is not running; and/or the countermeasure is the electric motor being controlled to generate heat while the system is idle by running the electric motor at a low speed so as to act as a heat source, when the system is idle, and a check valve positioned downstream of the compressor impeller, and opens when the compressor impeller pressurizes a refrigerant to a sufficient pressure, and the low speed is defined as running the electric motor such that the compressor impeller will not pressurize the refrigerant enough to open the check valve; and/or the countermeasure is a rotor provided with an electric brake actuated when the system is idle, wherein the electric motor is an AC motor, and the electric brake is controlled by supplying a DC voltage to the electric motor.

12. The method as set forth in claim 11, wherein the electric motor includes the rotor driving a shaft to in turn drive the impeller, and the shaft is supported on the magnetic bearings, and the countermeasure includes actuating the magnetic bearings to deliver heat into the housing when the electric motor is not driving the impeller.

13. The method as set forth in claim 11, wherein the electric motor includes a rotor provided with the electric brake, and the countermeasure includes actuating the electric brake while the electric motor is not driving the impeller.

14. The method as set forth in claim 13, wherein the electric motor is the AC motor, and the countermeasure is the electric brake is controlled by supplying the DC voltage to the electric motor.

15. The method as set forth in claim 14, wherein the countermeasure is actuated at least thirty seconds before an intended startup of the electric compressor.

16. The method as set forth in claim 11, wherein the countermeasure running the electric motor at low speed.

17. The method as set forth in claim 16, wherein the check valve is positioned downstream of the compressor impeller, and opens when the compressor impeller pressurizes the refrigerant to the sufficient pressure, and the low speed is defined as running the electric motor such that the compressor impeller will not pressurize the refrigerant enough to open the check valve.

18. The method as set forth in claim 11, wherein the countermeasure is actuated at least thirty seconds before an intended startup of the electric compressor.

19. The method as set forth in claim 11, wherein the countermeasure is cycled on and off.

20. The method as set forth in claim 11, wherein the countermeasure is disabled if a threshold temperature is reached within the electrical compressor.

* * * * *